US005116039A

United States Patent [19]

Braen et al.

[11] Patent Number: 5,116,039

[45] Date of Patent: May 26, 1992

[54] APPARATUS FOR FEEDING SHEETS FROM A STACK THEREOF

[75] Inventors: Henry P. Braen, Wilton; William J. Wright, Killingworth; Eric A. Belec, Southbury, all of Conn.

[73] Assignee: Pitney Bowes Inc., Stamford, Conn.

[21] Appl. No.: 577,725

[22] Filed: Sep. 5, 1990

[51] Int. Cl.[5] ..... B65H 3/04

[52] U.S. Cl. ..... 271/34; 271/2; 271/149

[58] Field of Search ..... 271/149, 150, 2, 34, 271/35, 160

[56] References Cited

U.S. PATENT DOCUMENTS

| | | | |
|---|---|---|---|
| 2,988,355 | 6/1961 | Rabinow et al. | 271/150 X |
| 3,817,516 | 6/1974 | Lazzarotti | 271/150 |
| 3,966,193 | 6/1976 | Storace et al. | 271/150 |
| 4,299,379 | 11/1981 | Preston et al. | 271/149 X |
| 4,302,000 | 11/1981 | Frank | 271/150 |
| 4,757,985 | 7/1988 | Hamant et al. | 271/149 X |
| 4,955,596 | 9/1990 | Ricciardi | 271/150 X |

OTHER PUBLICATIONS

Johnson, "Edge Feed Loader for Mail Transport", Jul. 1975, IBM Tech. Bulletin, vol. 19, No. 2, p. 623.

*Primary Examiner*—Robert P. Olszewski
*Assistant Examiner*—Boris Milef
*Attorney, Agent, or Firm*—Donald P. Walker; David E. Pitchenik; Melvin J. Scolnick

[57] ABSTRACT

An apparatus for feeding sheets having folded edges comprising: a support for supporting a stack of upright sheets respectively on an edge thereof; a sliding wall engaged by a toothed belt for feeding the sheets in a path of travel; an endless belt having an upper run disposed for engagement of the edges of the sheets for feeding the sheets in a direction extending transverse to the path of travel; and a front wall resiliently biased against each sheet fed from the stack for exerting a force in a direction opposite to the path of travel.

17 Claims, 2 Drawing Sheets

APPARATUS FOR FEEDING SHEETS FROM A STACK THEREOF

This application is related to application Ser. No. 07/577,975 for Sheet Feeding Apparatus filed concurrently herewith by the same inventor and assigned to assignee hereof.

BACKGROUND OF THE INVENTION

This invention is generally concerned with sheet feeding apparatus and more particularly with apparatus for feeding sheets respectively supported on an edge thereof, whereby such sheets are fed in an upright orientation thereof.

In U.S. Pat. No. 4,302,000 for Apparatus For Separating A Letter Stack, issued Nov. 24, 1981 to Warner Frank, there is shown sheet feeding structure wherein sheets are fed on their edges from a stack of sheets. In the Patent, a spring loaded supporting wall at the upstream end of the stack is intermittently moved in a downstream path of travel by a switch actuated drive system, and belt structure at the downstream end of the stack feeds the sheets from the stack. A pair of springs are provided for spring loading the upstream sheet supporting wall, and the drive system includes an arm which compresses the springs against the wall for moving the same whenever the force being exerted by the stack against the belt structure does not exceed a value which causes the drive system's switch to be actuated. The spring structure is provided to ensure that the force exerted against the belt structure, which reliably feeds sheets only when that force is within a predetermined range of values, will not attain unduly high values.

It has been found that although the spring structure shown in the Patent generally enhances the feeding reliability of the belt structure, the mass of the stack normally includes unavoidable air pockets which tend to dampen the effect of the springs. Moreover, since the forces exerted by the springs are unevenly relieved when thick sheets are fed from the stack, and a given sheet may be of varying thickness along its feeding length, the forces exerted on the belt structure may vary considerably as a given sheet is being fed from the stack. As a result, the drive system tends to require continuous adjustment to achieve reliable sheet feeding with sheets of different thicknesses. Accordingly:

An object of the invention is to provide improved apparatus for feeding sheets of different thickness;

Another object is to provide apparatus for feeding sheets from a stack, including improved structure for controlling the force exerted by the stack against a guide wall; and Another object is to provide sheet feeding apparatus including means for exerting a substantially constant resultant force against respective sheets fed from the stack.

SUMMARY OF THE INVENTION

Apparatus for feeding sheets comprising: means for supporting a stack of upright sheets respectively on an edge thereof; means for feeding the stack in a path of travel; means for feeding said sheets on their respective edges from said stack in a direction extending transverse to said path of travel, said sheet feeding means including an endless belt having a belt run disposed for engagement of the respective edges of said sheets; and means for exerting a force in a direction opposite to said path of travel against each sheet fed from said stack.

BRIEF DESCRIPTION OF THE DRAWING

As shown in the drawings, wherein like reference numerals designate like or corresponding parts throughout the several views.

DESCRIPTION OF THE PREFERRED EMBODIMENTS

Figure 1B:
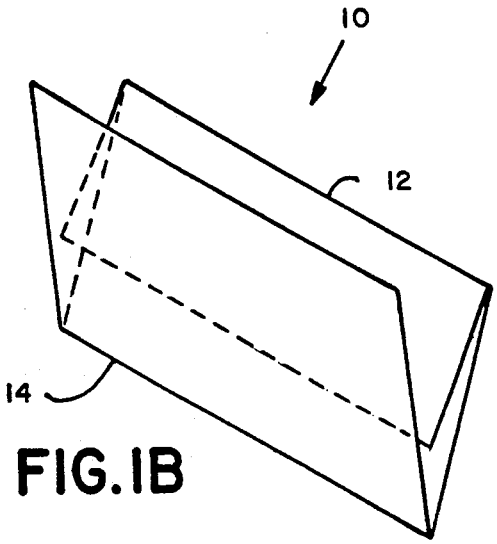
FIG. 1*b* is a perspective view of another typical folded cut sheet which may be processed according to the invention.
Figure 1A:
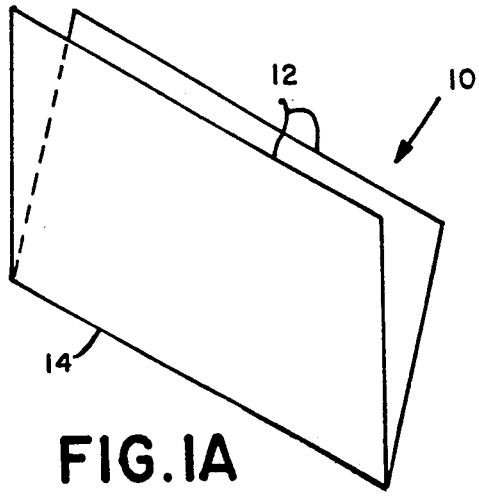
FIG. 1*a* is a perspective view of a typical folded cut sheet which may be processed according to the invention.
Figure 1C:
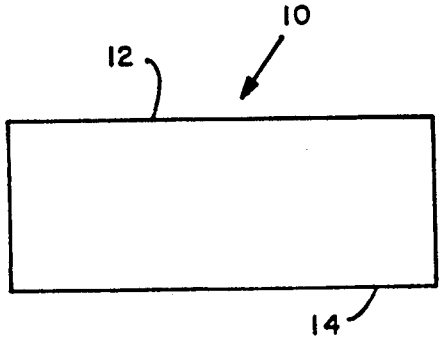
FIG. 1*c* is a plan view of another typical sheet, such as a card, cut sheet, letter, remittance slip, or the like, which may be processed according to the invention.
Figure 1D:
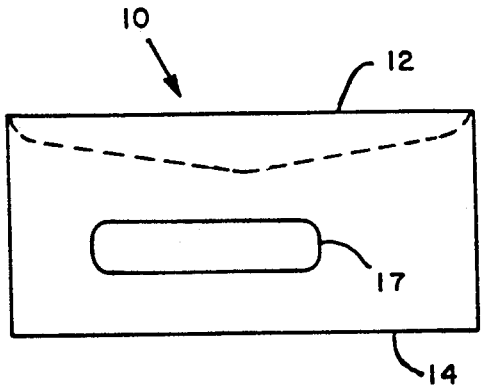
FIG. 1*d* is a plan view of yet another typical sheet, such as unsealed envelope with or without a window, which may be processed according to the invention.

As shown in FIG. 1*a*, a typical sheet 10 which may be processed in accordance with the invention may comprise a folded cut sheet or letter having opposed elongate edges 12 and 14, one of which, edge 14, is a fold edge. Another typical sheet 10 (FIG. 1*b*) may comprise a multiply folded cut sheet or letter including two elongate fold edges 12 and 14. Another typical sheet 10 (FIG. 1*c*) may comprise a cut sheet, letter, card or remittance slip, or the like, having opposed elongate edges 12 and 14. A still further typical sheet 10 (FIG. 1*d*) may comprise an unsealed envelope, having opposed elongate fold edges 12 and 14, which may or may not include a conventional window 17. And, yet another typical sheet 10 (FIG. 1*e*) may comprise a sealed envelope stuffed with one or more insert sheets 10 such as one or more of the sheets 10 shown in FIGS. 1*a*–1*d* inclusive.

Figure 1E:
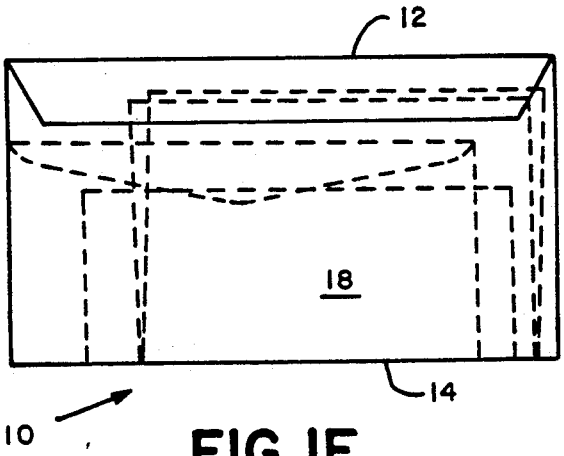
FIG. 1*e* is a plan view of another typical sheet, such as a envelope stuffed with a plurality of inserts having different dimensions, which may be processed according to the invention.
Figure 1F:
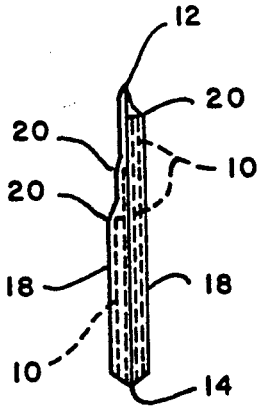
FIG. 1*f* is an end view of the stuffed envelope shown in FIG. 1*e*, showing variations in the thickness of the stuffed envelope longitudinally of its length.

As shown in FIG. 1*f* the opposed surfaces 18 of the stuffed envelope shown in FIG. 1*e* includes a plurality of ridges 20 (FIG. 1*f*), which are formed both longitudinally and transversely of the length of the envelope by the insert sheets 10 (FIG. 1*e*) stuffed in the envelope.

According to the invention, the apparatus 30 (FIG. 2) for processing sheets 10 generally includes conventional framework 32. Further, the apparatus 10 preferably comprises sheet, or stack, supporting structure 34 including an elongate, generally rectangularly-shaped, deck 36 which is suitably connected to the framework 32 for orientation thereof in a generally horizontally-extending plane.

Figure 2:
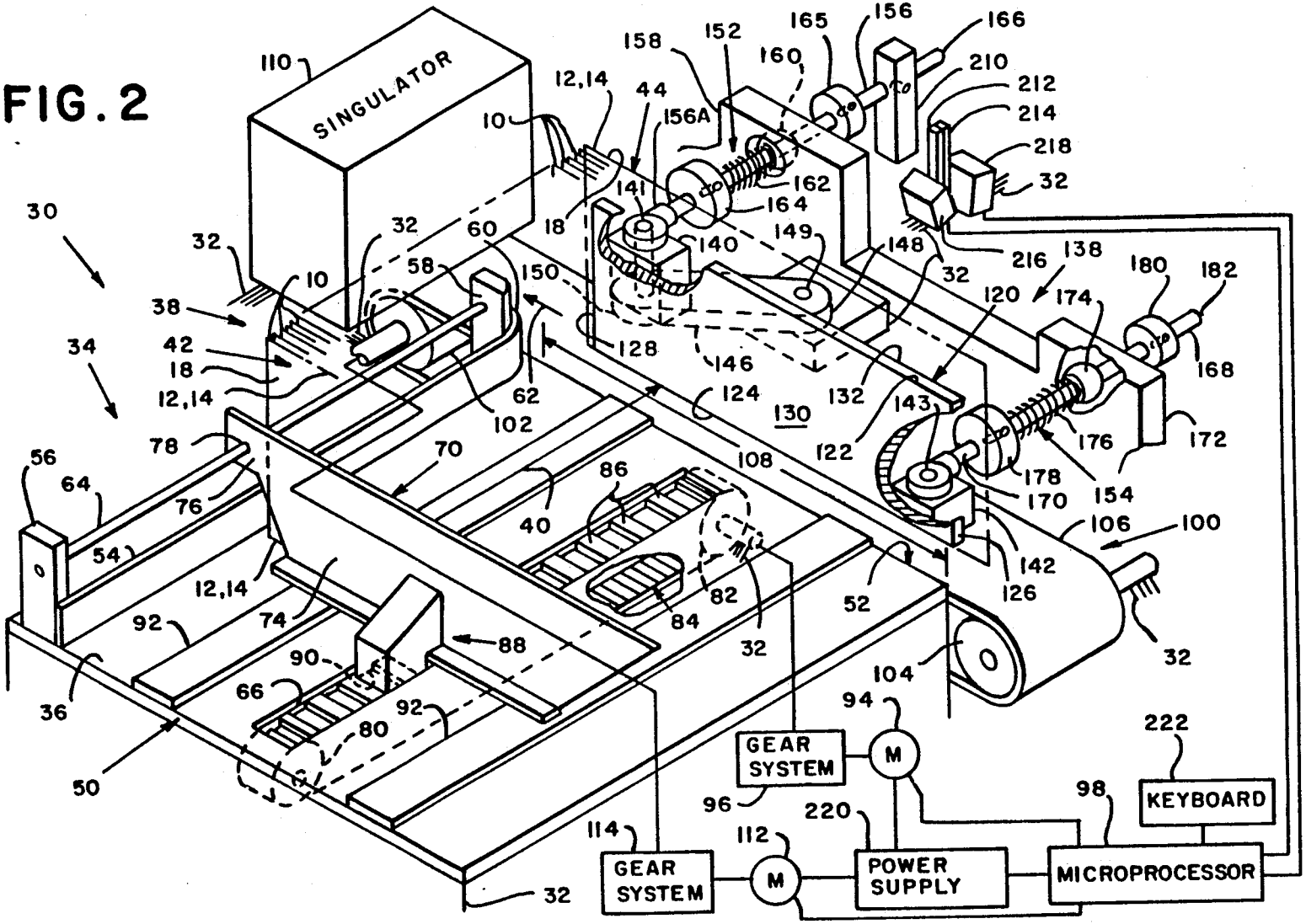
FIG. 2 is a partially schematic perspective view of sheet feeding apparatus according to the invention.

As shown in FIG. 2, a stack 38 of a plurality of sheets 10 are each supported on one of their elongate edges, 12 or 14, on the deck 36 for feeding thereon in a downstream path of travel 40. And, assuming the stack 38 includes sheets 10 having one or more fold edges, 12 or 14, they are preferably supported on a fold edge 12 or 14. Thus each of the sheets 10 of the stack 38 has opposed upper and lower elongate edges, 12 or 14, and opposed upright surfaces 18, and the stack 38 has an upstream end 42 and a downstream end 44 relative to the path of travel 40.

The sheet, or stack, supporting structure 34 (FIG. 2) and the deck 36 share an upstream end 50 and a downstream end 52. And the structure 34 additionally includes an elongate, upright, side wall 54 against which the sheets 10 of the stack 38 may be disposed in edge registration. The side wall 54 is preferably connected to a pair of upright, framework posts 56 and 58, which are spaced apart from one another and located alongside of opposite ends, 50 and 52, of the deck 36, for supporting the side wall 54 in a substantially vertical plane extending therealong. Preferably, the downstream end 60 of the side wall 54 curvedly-extends about the downstream post 58 for guiding sheets 10, fed from the stack 38, out of the path of travel 40 and into a transverse path of travel 62 which preferably extends perpendicularly-transverse to the downstream path of travel 40.

In addition, the sheet or stack supporting structure 34 (FIG. 2) includes an elongate bar 64 which is conventionally connected to and extends between the framework posts 56 and 58. And the deck 36 has an elongate, generally rectangularly-shaped, aperture 66 formed therein so as to extend parallel to the bar 64, and longitudinally of the length of the deck 36, between the deck's upstream and downstream ends 50 and 52.

For feeding the stack 38 (FIG. 2), and thus the sheets 10 thereof, in the downstream path of travel 40 on and beyond the downstream end 52 of the deck 36, the apparatus 30 includes a movable wall 70, which is disposed in engagement with the stack's upstream end 42. The wall 70, preferably includes a generally rectangularly-shaped portion 74, which engages the stack's upstream end 42, and includes an arm portion 76. The arm portion 76 has an opening 78 formed therein which is dimensioned to receive therethrough the elongate bar 64, for pivotably attaching the arm portion 76, and thus the movable wall 70, to the bar 64. As thus constructed and arranged, the arm portion 76, and thus the movable wall 70, is slideably connected to the bar 64 for movement longitudinally of the length of the supporting structure 34 and thus the deck 36. In addition, for moving the wall 70, the apparatus 30 preferably includes a pair of pulley-type gears, 80 and 82, which are spaced apart from each other and conventionally connected to the framework 32 so as to extend transversely of the sheet supporting structure 34, beneath the deck's upstream and downstream ends 50 and 52. And, the apparatus 30 includes an endless timing belt 84 which is looped about and disposed in meshing engagement with the pulley gears 80 and 82. Further, the belt 84 includes a plurality of gear teeth 86 which are formed in the outer surface of the belt 84. And the apparatus 30 includes a depending foot member 88 which is conventionally fixedly attached to the wall portion 74, as by welding, and extends downwardly through the deck's aperture 66. The foot member 88 includes a plurality of gear teeth 90 which are normally disposed in meshing engagement with timing belt's outer gear teeth 86. In addition, for slidably supporting the lower elongate ends, 12 or 14, of the sheets 10 on the deck 36, the apparatus 10 may include a plurality of, such as two, elongate strips 92, made of a plastic material, such as teflon, which are conventionally adhesively connected to the deck 36 on opposite sides of the deck's aperture 66, so as to extend longitudinally of the length of the deck 36. Still further, for feeding the stack 38 in the downstream path of travel 40, the apparatus 30 includes conventional structure for driving the pulley gear 82, including a conventional motor 94, such as a suitable stepper motor, a suitable gear system 96 which is connected in driving engagement with the pulley gear 82 and in driven engagement with the motor 94, and a conventional control circuit, such as a suitable microprocessor 98, which is conventionally connected to the motor 94 for control thereof as hereinafter discussed in greater detail.

For separating sheets 10 (FIG. 2) from the stack 38 and feeding the sheets 10 into the transverse path of travel 62, the apparatus 10 preferably comprises a belt system 100 including a pair of rollers, 102 and 104, which are spaced from each other and conventionally connected to the framework 32 so as to axially extend parallel to the path of travel 40. Moreover the rollers 102 and 104 extend downstream of and below the level of the deck's downstream end 52. In addition, the belt system 100 includes an endless belt 106 which is looped about and disposed in driven engagement with the rollers 102 and 104. The belt 106 includes a belt run 108 which extends perpendicularly transverse to the path of travel 40 for receiving thereon the lower elongate edges, 12 or 14, of respective sheets 10, which are fed in the path of travel 40 beyond the deck's downstream and 52, separating such sheets 10 from the stack 38 and feeding the sheets 10 into the transverse path of travel 62, and thus away from the supporting structure 30 for further processing, preferably as by means of conventional sheet singulating structure 110. For driving the belt system 100, the apparatus 30 includes a conventional motor 112, a suitable gear system 114 which is conventionally connected in driving engagement with the roller 102 and in driven engagement with the motor 112, and a conventional control circuit, such as the microprocessor 98, which is conventionally connected to the motor 112 for control thereof as hereinafter discussed in greater detail.

As shown in FIG. 2, for guiding sheets 10 separated and fed from the stack 38, into the path of travel 62, the apparatus 30 preferably comprises an elongate, generally rectangularly-shaped, wall 120. The wall 120 has opposed upper and lower, longitudinally-extending, edges 122 and 124, and has opposed upstream and downstream, transversely-extending, edges 126 and 128. In addition, the wall 120 has opposed surfaces 130 and 132, one of which, i.e., surface 130 is disposed faces the downstream end 44 of the stack 38 and is oriented for receiving, in sliding engagement therewith, the successive sheets 10 fed from the stack 38. Preferably, the stack facing surface 130 is conventionally treated with a plastic material, such as teflon, for reducing frictional engagement by the respective sheets 10 fed from the stack 10, thereby augmenting sliding engagement of such sheets 10 with the surface 130.

As shown in FIG. 2, the apparatus 30 additionally comprises structure 138 for resiliently urging the guide wall 120 toward the stack 38, whereby the guide wall 120 is urged into contact with the upright surfaces 18 of successive sheets 10 of the stack 38. And, more particularly, the structure 138 is constructed and arranged for exerting a substantially constant, resultant, force in a direction extending opposite to the path of travel 40, against the downstream upright surface 18 of each of the sheets 10 as they are fed from the stack 38. To that end, the apparatus 30 preferably includes a first pivot shaft supporting member 140 which is conventionally fixedly attached to the wall surfaces 132, as by welding, so as to extend downstream, relative to the path of travel 40 from a portion of the wall surface 132 adjacent to the intersection of the wall's upper and downstream edges 122 and 128. In addition, the apparatus 30 includes a first pivot shaft 141 which is conventionally attached to the member 140 so as to extend both vertically upwardly and downwardly therefrom. Further, the apparatus 30 includes a second pivot shaft supporting member 142 which is conventionally fixedly attached to the wall surface 132, as by welding, so as to extend downstream, relative to the path of travel 40, from a portion of the wall surface 132 adjacent to the intersection of the wall's lower and upstream edges 124 and 126. And, the apparatus 30 includes a second pivot shaft 143 which is conventionally attached to the member 142 so as to extend vertically upwardly therefrom. In addition, the structure 38 for resiliently urging the guide wall 120 toward the stack 38 includes an elongate, generally rectangularly-shaped, member 146 for pivotally supporting the guide wall 120. To that end, one end, 148, of the member 146 is conventionally pivotably attached to the framework 32, as by means of a pivot shaft 149, and the lower end of the pivot shaft 141 is conventionally vertically mounted for rotation on the other end 150 of the member 146 so as to permit pivotal movement between the shaft 141 and member 146. In addition, the apparatus 30 includes a pair of elongate resilient structures, 152 and 154, which are connected to the framework 32 and to the guide walls 120, such that the upstream and downstream edges 126 and 128, are independently movable toward and away from successive sheets 10 fed from the stack 38, to permit guide wall's outer surface 130 to track the downstream surfaces 18 and thus the surface ridges 20 which may be present in respective upright surfaces 18 of successive sheets 10 (FIG. 2), as they are fed from the stack 38.

The resilient structure 152 (FIG. 2) includes an elongate rod 156 having one end, 156A, conventionally pivotably attached to the upper end of the pivot shaft 141. The rod 156 extends downstream, relative to the path of travel 40, from the pivot shaft 141 and into an upright framework post 158 having a swivel bearing 160 mounted therein for lengthwise receiving therethrough the rod 156. In addition, the resilient structure 152 includes a compression spring 162 connected between the framework post 158 and a stop 164. Preferably, the stop 164 is adjustably connected to the rod 156, to permit adjusting the initial compression of the spring 162 against the swivel bearing 160, whereby the force exerted by the downstream end of the guide wall 120 against the stack's downstream end 44 may be adjusted to a predetermined minimum, or threshold, level for reliably feeding sheets 10 from the stack 38. And, the resilient structure 152 includes another stop 165 which is conventionally adjustably connected to the rod 156 between the framework post 158 and the free end 166 of the rod 156, to permit adjusting the initial location of the pivot shaft 141 relative to the path of travel 40, whereby the downstream end of the guide wall 120 may be adjustably located in the path of travel 40 to accommodate feeding sheets 10 of different thicknesses.

The resilient structure 154 (FIG. 2) includes an elongate rod 168 having one end, 170, conventionally pivotably attached to the upper end of the pivot shaft 143. The rod 168 extends downstream, relative to the path of travel 40, from the end of the pivot shaft 142, and into an upright framework post 172 having a swivel bearing 174 mounted therein for lengthwise receiving therethrough the rod 168. In addition, the resilient structure 154 includes a compression spring 176 connected between the swivel bearing 174 and a stop 178. The stop 176 is preferably adjustably connected to the rod 168, to permit adjusting initial compression of the spring 176 against the swivel bearing 174, whereby the force exerted by the upstream end of the guide wall 120 against the stack's downstream end 44 may be adjusted to the predetermined minimum, or threshold, level for reliably feeding sheets 10 from the stack 38. And, the resilient structure 154 includes another stop 180 which is conventionally adjustably connected to the rod 168 between the framework post 172 and the free end 182 of the rod 168, to permit adjusting the initial location of the pivot shaft 143 relative to the path of travel 40, whereby the upstream end of the guide wall 120 may be adjustably located in the path of travel 40 to accommodate feeding sheets of different thicknesses.

In operation, the stack 38 is fed downstream in the path of travel 40 against the force exerted by the guide wall 120 on the downstream upright surfaces 18 of respective sheets 10 fed from the stack 38. For controlling downstream movement of the stack 38 (FIG. 2) and thus the sheets 10, in the path of travel 40, and controlling the maximum force exerted by the guide wall 120 against the respective sheets 10 fed from the stack 38, the apparatus 30 includes a depending finger member 210 which is connected to the rod 156 for movement therewith into and out of actuating engagement with the leaf spring-type switching poles, 212 and 214, of two microswitches, 216 and 218, which are conventionally electrically connected to the microprocessor 98. Preferably, the finger member 210 is conventionally adjustably connected to the rod 156 to permit changing the location of the finger member 210 relative to the switching pole 212, whereby the finger member 210 may be located at a predetermined position along the rod 156 for actuating the switch 216 when the force exerted by the upstream end of the guide wall 120 against the stack's downstream end 44 increases to a predetermined maximum permissible level for reliably feeding sheets 10 from the stack 38. Further, the switch 216 is preferably a normally closed switch, and the switch 218 is preferably a normally open switch. Further, the switches 216 and 218 are respectively conventionally connected to the framework 32 for disposing their respective leaf spring-type switching poles, 212 and 214, in slidable engagement with each other, whereby movement of either of the switching poles, 212 or 214, causes movement of the other switching pole, 214 or 212. Moreover, the switching poles 212 and 214 are located relative to each other such that the pole 214 normally resiliently retains the pole 212 in a position wherein the switch 216 is closed.

In addition, for controlling movement of the stack 38 (FIG. 2) and the force exerted by the guide wall 120 against successive sheets 10, the microprocessor 98 is conventionally programmed for energizing both of the motors 94 and 112, in the presence of signals from the switches 216 and 218 which indicate that the normally closed switch 216 is closed and the normally open switch 218 is open, to cause the movable wall 70, and thus stack 38, to move downstream in the path of travel 40, and to cause the belt 106 to successively separate sheets 10 from the stack 38 and feed the separated sheets 10 into the transverse path of travel 62. Moreover, the microprocessor 98 is conventionally programmed to deenergize the motor 94, in the presence of signals from the switches, 216 and 218, which indicate that the normally closed switch 216 is open and the normally open switch 216 is open, i.e., when the finger member 210 actuates the switch 216 but does not actuate the switch 218, to deenergize the motor 94 to stop downstream movement of the stack 38, and to continue energization of the motor 112 to permit continued movement of the belt 106, for continuing to successively separate and feed sheets from the stack 38.

For stopping sheet feeding from the stack 38 in the event of a jam condition, for example when sheets 10 fed from the stack 10 accumulate between the downstream end of the stack 38 and guide wall 120 and singulating structure 110, the microprocessor 98 is conventionally programmed to deenergize both of the motors, 94 and 112, in the presence of signals from the switches 216 and 218 which indicate that the normally closed switch 216 is open and the normally open switch 218 is closed, i.e., when the force exerted by the guide wall 120 against the stack 38 exceeds the maximum predetermined permissible level and the finger member 210 actuates both switches 216 and 218, to maintain deenergization of the motor 94, to continue to stop downstream movement of the stack 38, and to deenergize the motor 112 to stop feeding sheets 10 from the stack 38.

Accordingly, the apparatus 30 is constructed and arranged such that the belt 84 under the control of the microprocessor 98, is normally intermittently moved for feeding sheets 10 in the path of travel 40 in timed relationship with the belt system 100 reliably feeding sheets 10 from the stack 38. And, the apparatus 30 is constructed and arranged such that the belt system 100 ceases feeding sheets 10 from the stack 10 when the belt system 100 is no longer operable for reliably feeding sheets 10 from the stack 38.

Further, the apparatus 30 includes a conventional power supply 220 which is suitably connected to the respective motors 94 and 112, and to the microprocessor 98, to provide power thereto. And, the apparatus 30 may include an appropriate operator interface, such as a keyboard 222 which is conventionally connected to the microprocessor 98 for initiating and discontinuing operation of the apparatus 30 in accordance with operator input from the keyboard 222.

In accordance with the objects of the invention there has been disclosed improved means for feeding sheets of different thicknesses from a stack, including improved structure for controlling the force exerted by a guide wall against successive sheets fed from the stack. In particular, there is provided improved structure for exerting a substantially constant force against respective sheets fed from the stack.

What is claimed is:

1. Apparatus for feeding sheets comprising:

a. means for supporting a stack of upright sheets respectively on an edge thereof, the stack having a downstream end, the stack supporting means including an upright wall at the downstream end of the stack;

b. means for feeding the stack in a path of travel;

c. means for feeding successive sheets on their respective edges from said stack in a direction defined by said wall and extending transverse to said path of travel, said wall, having an upstream end and a downstream end relative to said transverse direction, said sheet feeding means including an endless belt having a belt run disposed for engagement of the respective edges of said sheets, said belt run feeding said respective sheets in sliding engagement with said wall;

d. means for exerting a force in a direction opposite to said path of travel against each sheet as it is successively fed from said stack, and said force exerting means including means for independently resiliently urging the upstream and downstream ends of said wall into engagement with said each successive sheet.

2. The apparatus according to claim 1, wherein said stack has an upstream end, said stack feeding means including a second upright wall disposed in engagement with said upstream end, the stack supporting means including a downstream end, and said stack feeding means including means for incrementally moving said second wall and thus said stack in said path of travel toward said downstream end of said sheet supporting means.

3. The apparatus according to claim 1, wherein said stack feeding means includes a stepper motor, and said stack feeding means including means for operating said stepper motor and said belt moving means in a timed relationship with each other.

4. The apparatus according to claim 2, wherein said stack feeding means includes a gear belt including a plurality of teeth, said second upright wall disposed in engagement with at least one of the teeth, and said stack feeding means including means for incrementally moving said gear belt and thus said second upright wall in timed relationship with feeding respective sheets from the stack.

5. The apparatus according to claim 1 wherein said sheet feeding means includes a pair of rollers spaced apart from each other and axially extending parallel to said path of travel, said belt looped about said rollers, and said stack feeding means successively moving respective sheets of the stack into engagement with said belt run to permit said belt to successively engage said edges for separating successive sheets from said stack.

6. The apparatus according to claim 1, wherein each of said edges is a fold edge.

7. Apparatus for feeding sheets respectively having an elongate fold edge, the apparatus comprising:

a. means for supporting a stack of said sheets on their respective fold edges, the supporting means having a downstream end;

b. means for moving the stack and thus the sheets thereof in a downstream path of travel extending beyond the downstream end of the stack supporting means;

c. means beyond the downstream end of the stack supporting means for feeding respective sheets from the stack, said sheet feeding means including an upright wall extending transverse to said path of travel, said sheet feeding means including means for frictionally engaging the fold edges of respective sheets fed beyond the downstream end of said stack supporting means and feeding said sheets from said stack in a direction defined by said wall and in sliding engagement therewith, said wall having an upstream end and a downstream end relative to the direction in which respective sheets are fed from said stack;

d. means for resiliently urging said wall towards said stack, said resilient means including a first spring for urging the upstream end of said wall towards the stack, and said resilient means including a second spring for urging the downstream end of said wall towards said stack, whereby the upstream and downstream ends of said wall are independently resiliently urged towards said stack.

8. Apparatus for feeding sheets in an upright orientation thereof wherein each sheet has opposed upright surfaces and a lower edge, the apparatus comprising:

a. means for supporting a stack of said sheets in said upright orientation thereof, the stack supporting means having a downstream end;

b. first means for feeding said sheets of said stack in a first path of travel extending beyond said downstream end of said stack supporting means;

c. second means for feeding said sheets from said stack in a second path of travel extending transverse to said first path of travel, said second sheet feeding means including means for frictionally engaging the lower edges of successive sheets fed beyond said downstream end of said sheet supporting means;

d. said stack supporting means including an elongate guide wall extending transverse to said first path of travel for guiding successive sheets in and defining said second path of travel, said second sheet feeding means feeding successive sheets in sliding engagement with said guide wall, said guide wall having a downstream end and an upstream end relative to said second path of travel, first means including a first spring for urging the upstream end of said guide wall toward said stack, and second means including a second spring for urging the downstream end of said guide wall toward said stack, whereby said upstream and downstream ends of said guide wall are independently urged toward said stack.

9. The apparatus according to claim 8, wherein said means for frictionally engaging includes a belt.

10. The apparatus according to claim 9, wherein said belt includes an upper belt run having an outer surface disposed for frictional engagement of said lower edges of successive sheets.

11. The apparatus according to claim 8, wherein said stack has an upstream end, and said first sheet feeding means including means for engaging the upstream end of said stack.

12. The apparatus according to claim 8, wherein said second sheet feeding means includes a switch, and said first sheet feeding means including means for incrementally moving the stack in said path of travel in response to actuation of said switch.

13. The apparatus according to claim 11, wherein said stack supporting means includes an elongate feed deck, said stack supporting means including an elongate side wall extending parallel to said first path of travel, said stack engaging means slidably connected to said side wall, and said first sheet feeding means including means for intermittently moving said stack engaging means and thus said stack in said downstream path of travel, whereby the sheets of said stack are intermittently fed in said downstream path of travel.

14. The apparatus according to claim 8 including means for operating said first sheet feeding means in a timed relationship with said second sheet feeding means.

15. The apparatus according to claim 13, wherein said means for intermittently moving said stack engaging means includes a first belt, and said stack engaging means comprises a wall including a portion thereof disposed in engagement with said first belt.

16. The apparatus according to claim 8, wherein the lower edge is a fold edge.

17. The apparatus according to claim 15 wherein said means for intermittently moving said stack engaging means includes a stepper motor connected in driving engagement with said first belt.

* * * * *